US006514380B1

(12) United States Patent
Laine et al.

(10) Patent No.: US 6,514,380 B1
(45) Date of Patent: Feb. 4, 2003

(54) TREATMENT OF CHEMICAL PULP

(75) Inventors: Antero Laine, Kotka (FI); Olavi Pikka, Karhula (FI)

(73) Assignee: Andritz Oy, Helsinki (FI)

( * ) Notice: Subject to any disclaimer, the term of this patent is extended or adjusted under 35 U.S.C. 154(b) by 297 days.

(21) Appl. No.: 09/048,289

(22) Filed: Mar. 26, 1998

Related U.S. Application Data

(63) Continuation-in-part of application No. 08/613,008, filed on Mar. 8, 1996, now abandoned.

(30) Foreign Application Priority Data

Mar. 10, 1995 (FI) ..... 951069

(51) Int. Cl.[7] ..... D21C 7/06; D21C 9/02; D21C 9/147

(52) U.S. Cl. ..... 162/52; 162/55; 162/60; 162/65

(58) Field of Search ..... 162/60, 65, 55, 162/52

(56) References Cited

U.S. PATENT DOCUMENTS 4,220,498 A * 9/1980 Prough ..... 162/65
4,595,455 A * 6/1986 Mannbro ..... 162/65
4,895,619 A * 1/1990 Ahs et al. ..... 162/65
4,946,556 A * 8/1990 Prough ..... 162/65

FOREIGN PATENT DOCUMENTS

CA 2132056 * 3/1995 ..... 162/65

* cited by examiner

*Primary Examiner*—Steve Alvo
(74) *Attorney, Agent, or Firm*—Nixon & Vanderhye P.C.

(57) ABSTRACT

Chemical pulp is produced by cooking comminuted cellulosic fibrous material (e.g. wood chips) in a continuous digester or batch digesters or produce brown stock, and washing the brown stock in a brown stock washer to produce chemical pulp, oxygen delignifying the chemical pulp at medium consistency, and then screening the oxygen delignified pulp to produce an accept fraction and a shive-containing reject fraction. Drawbacks inherent in the prior art are overcome by directly transporting (i.e. without refining or accessory oxygen delignification) the shive-containing rejects fraction to the main fiber line before oxygen delignification (e.g. to just before a mixer for the oxygen delignification stage, to between the brown stock washer and mixer, to a coarse screen between the digester and the brown stock washer, and/or to a washer for the coarse rejects from the coarse screen). The oxygen delignification stage may include at least two upflow vessels, of different first and second stages, with a mixer before each stage, and at least one of the vessels includes a multiple feeding device. Gas separation can also be practiced in one or all of the oxygen delignification vessels. The screening stage may be provided before or after a washer for washing the oxygen delignified pulp.

22 Claims, 4 Drawing Sheets

TREATMENT OF CHEMICAL PULP

CROSS-REFERENCE TO RELATED APPLICATION

This application is a continuation-in-part of application Ser. No. 08/613,008, filed Mar. 8, 1996, now abandoned.

BACKGROUND AND SUMMARY OF THE INVENTION

The invention relates to a method and a fiber line system for producing chemical pulp in such a way that shive-containing rejects from screening are minimized and reprocessed in a cost-effective and advantageous manner. The invention has a number of advantages over previously known methods of treating chemical pulp after cooking for minimizing the amount of reject material in the final pulp produced.

U.S. Pat. No. 4,220,498 (the disclosure of which is hereby incorporated by reference herein) discloses a number of different alternatives for the treatment of chemical pulp after cooking in order to reduce the amount of reject material. In some sequences the pulp is screened prior to oxygen delignification and the rejects are subjected to further screening, refining, or accessory oxygen delignification. In other sequences the pulp is screened after oxygen delignification, but again is subjected to refining and typically other treatment, such as accessory oxygen delignification.

U.S. Pat. No. 4,895,619 (the disclosure of which is hereby incorporated by reference herein) suggests eliminating problems associated with handling and reintroducing the screen rejects from a screening stage that are associated with the U.S. Pat. No 4,220,498 by simply oxygen delignifying the rejects fraction exteriorly of the fiber line, and then returning it to the delignified rejects fiber line prior to the oxygen delignification stage in the fiber line.

U.S. Pat. No. 4,595,455 discusses a brown stock treatment process where the digested brown stock is first coarse screened, and then washed and pressed to high consistency, i.e. to about 30% consistency. After pressing the stock is fluffed into an oxygen delignification tower where the stock is delignified. The stock discharged from the delignification tower is diluted to low consistency and screened. The screened accepts are introduced to further processing in the main process line and the rejects are turned back to the feed of the brown stock press.

A significant drawback in the above-described process is the treatment consistency and its effect on the shives. Firstly, it should be understood that at high consistency (i.e. a consistency above 25%) delignification is a difficult task. In actual mill-scale operations it has been found that there are problems with the delignification efficiency in the high consistency delignification of fibers. Therefore, it is not a surprise that shives will not be loosened into fiber form but will maintain their original shape and "strength".It could even be said that the only thing that tends to break the shives in U.S. Pat. No. 4,595,455 is the screening and other mechanical working on the shives. The reason for this is that when the rejects received from the screening stage after delignification are returned directly to the brown stock press, the shives have very little time, not nearly enough time, to be impregnated by the alkaline liquor. Dilution and pressing in U.S. Pat. No. 4,595,455 are virtually successive operations since the shives do not have time to be impregnated by the liquor and are not treated efficiently at all in the delignification tower (only the surface of the shives is treated, i.e. delignificated). Also, at a consistency of 30% there is no alkaline liquid around the shives so that there cannot be any efficient mass transfer between the liquid and the shives.

While the prior art procedures as described above are reasonably effective in ensuring a minimum of reject material in the final pulp produced, they have a number of drawbacks associated therewith. When refining is used the pulp produced by the refiner is really chemi-mechanical pulp rather than chemical pulp, which can make the final pulp produced have different properties than are desired. Also the use of a refiner significantly increases the air content of the pulp which impairs the runnability of the entire process. In all cases with the prior art techniques as described above it is necessary to invest in additional capital equipment aside from the conventional fiber line, which equipment can be very expensive. For example accessory (outside of the fiber line) oxygen delignification equipment and/or refiners are highly capital intensive.

Compared to the prior art in general, as well as the specific prior art discussed above, the method and system according to the present invention have a number of advantages. In particular according to prior art typical screening procedures (where a screening stage is provided directly after the brown stock washer) the pulp foams significantly, and it is necessary to utilize a significant amount of anti-foaming agent in order to control the foaming problem. According to the invention a minimal amount—and perhaps zero—anti-foaming agent is necessary. Also, in the practice of the invention, because of the relatively low consistency during delignification (e.g. about 6–18%), there is always free liquid between the shives and fibers so that impregnation and mass transfer take place substantially throughout the process, not just during a short dilution/screening stage.

In many prior art techniques the pulp has already cooled off either before or during the thickening. For example vacuum washers have been utilized as thickeners. According to the present invention the pulp may be fed "hot" into the oxygen delignification stage or stages, improving the heat economy of the process.

In the prior art, reaction products and chemicals which pollute the environment have often been discharged along with the rejects. According to the present invention considerably less reaction products are discharged, and the amount of reject material is smaller, providing a more environmentally sound approach.

The invention is advantageous compared to prior art systems and methods even where the screening stages are disposed after oxygen delignification because the capital investments associated with the refiners and/or accessory oxygen delignification equipment (as described above with respect to U.S. Pat. Nos. 4,895,619 and 4,220,498) are unnecessary.

The invention is also advantageous in that according to the invention shives are softened and partly disintegrated during oxygen delignification, reducing the amount of reject material; and the screening stages may actually be considered part of the bleaching process, even employing a chelating stage, thus enabling efficient individual fiber treatment. In fact it is conceivable that utilizing the teachings of the invention it would be possible to omit entirely the screening stages by using particular oxygen delignification treatment, so that pulp does not contain any shives after oxygen delignification.

According to one aspect of the present invention a method of producing chemical pulp is provided comprising the following steps: (a) Cooking comminuted cellulosic fibrous material (e.g. wood chips) to produce brown stock. (b)

Washing the brown stock to produce chemical pulp. (c) Oxygen delignifying the chemical pulp at a consistency of between about 6–18% (preferably about 8–15%, e.g. about 10–13%). And, (d) screening the pulp from step (c) to produce at least an accept fraction and a shive-containing reject fraction. Steps (a) through (d) are practiced in a main fiber line, and then after step (d) there are the steps of: (e) Further treating (e.g. bleaching) the accept fraction, and (f) directly transporting the shive-containing reject fraction back to the main fiber line before step (c). Step (e) is typically practiced by bleaching the chemical pulp, with peroxide or other non-chlorine bleaching chemicals, and where peroxide bleaching is used a chelating stage is also employed. Step (c) is practiced at medium consistency (6–18%) to ensure sufficient alkaline liquid in the pulp during delignification so that impregnation and mass transfer between the liquid and shives takes place throughout at least all of steps (c) and (d).

The method according to the invention also typically is practiced in such a way that step (b) is practiced using a brown stock washer, and there is the further step of coarse screening the pulp with a coarse screen and washing the coarse rejects from the coarse screen; and wherein step (c) includes mixing oxygen with the medium consistency pulp in a mixer; and wherein step (f) is practiced to directly transport the reject fraction from step (d) to just before the mixer, or between the brown stock washer and the mixer, or to just before the coarse screen, or to the coarse reject washer. Also, steps (c)–(f) are preferably practiced to allow the reject fraction to be impregnated by alkaline liquid for enhancing the delignification and separation of fibers of and from shives.

Step (c) is typically practiced utilizing first and second distinct oxygen delignification, or more than first and second delignification, stages. A mixer is provided before the first stage and between the stages, with oxygen and typically other materials (such as magnesium, such as in the form of MgSO4, and typically alkali and steam, and may be even a small amount of hydrogen peroxide) are added. There typically is no between stage washing. Also step (c) is typically practiced utilizing upflow vessels and at least one of the upflow vessels comprises a multiple feeding device. The reject fraction from step (d) is acted upon between steps (a) and (d) utilizing mechanical action without refining, so that weak bonds of shives and the like are broken and so that a minimum amount of rejects (or perhaps none at all) are separated in the screening stage (d). The mechanical action is based on the use of medium consistency mechanical devices like the MC® ( mixers or MC® pumps which are mainly used for mixing chemicals with pulp or for transferring pulp from one process step to another.

The term "directly transporting" as used in the present specification and claims with respect to conveyance of pulp from after an in-line screening stage to before an in-line oxygen delignification stage means that the pulp is substantially only conveyed from one place to the other, e.g. by pumping or pressure differential, without refining or accessory oxygen delignification.

The term "mechanical action without refining" as used in the present specification and claims relating to physical activity to which the pulp is subjected means to subject the pulp to one or more mixers (including possibly fluidizing mixers) and mechanical inlet or discharge devices (such as scrapers or other rotating blades or paddles), so that weak bonds of shives and the like are broken, but without the intense mechanical energy provided by refining, which in essence actually results in the production of chemi-mechanical pulp.

Also according to the present invention typically there is the step of washing the pulp after oxygen delignification. This washing may take place either prior to or after screening. Also a chelating agent may be added to the washer especially where step (e) will be practiced to include peroxide bleaching.

According to another aspect of the present invention a method of producing chemical pulp is provided comprising the following steps: (a) Cooking comminuted cellulosic fibrous material to produce brown stock. (b) Washing the brown stock to produce chemical pulp. And, (c) oxygen delignifying the chemical pulp preferably at between about 6–18% consistency so that the shives are properly impregnated; and wherein oxygen delignification is practiced utilizing at least first and second distinct oxygen delignification stages each comprising an upflow vessel, and at least one of the vessels including a multiple feeding device. And, (d) during the practice of step (c), subjecting the pulp to mechanical action without refining so as to produce an oxygen delignified chemical pulp substantially devoid of shives so that downstream screening of the oxygen delignified pulp is unnecessary. The mechanical action without refining is typically practiced utilizing a mixer before the first oxygen delignification stage, a mixer before the first and second stages, a multiple feeding device for one of the stages, and various scrapers, inlets, discharge devices, medium consistency pumps, and other mechanical of the vessels. The shearing forces created by such feed, discharge, and mixing devices are weak compared to those of refiners. Rather than disintegrating the shives into fibers as is done by a refiner, and the mechanical devices practicing this aspect of the invention are successful because the bonds in the shives have been weakened to such an extent via oxygen delignification that the relatively weak mechanical action of these elements can break the shives into fibers, substantially eliminating the need for screening at all (except for a coarse screen, e.g. before the brown stock washing).

According to another aspect of the present invention a chemical pulp producing fiber line system is provided comprising: A fiber line comprising in sequence: a digester for cooking cellulosic fibrous material to produce brown stock; a first washer for washing the brown stock from the digester; at least one oxygen delignification stage; and a screening stage for screening chemical pulp from the oxygen delignification stage to produce an accepts fraction and a shive-containing rejects fraction. And, means for directly transporting the shive-containing rejects fraction to the fiber line before an oxygen delignification stage, and after the brown stock washer.

In the system the at least one oxygen delignification stage preferably comprises first and second upflow oxygen delignification vessels, at least one of the vessels comprising a multiple feeding device; and means for subjecting the pulp to mechanical action without refining while oxygen delignifying the pulp.

In the system the digester comprises a single continuous digester or a plurality of batch digesters; and there is a coarse screen between the digester and the screening stage, and an oxygen delignified pulp washer between the at least one oxygen delignification stage and the screening stage, or just after the screening stage.

It is the primary object of the present invention to provide a simple, advantageous, and cost effective method and system for producing chemical pulp having a minimum of reject material in the final pulp produced. This and other objects of the invention will become clear from an inspection of the detailed description of the invention and from the appended claims.

DETAILED DESCRIPTION OF THE DRAWINGS

Figure 1:
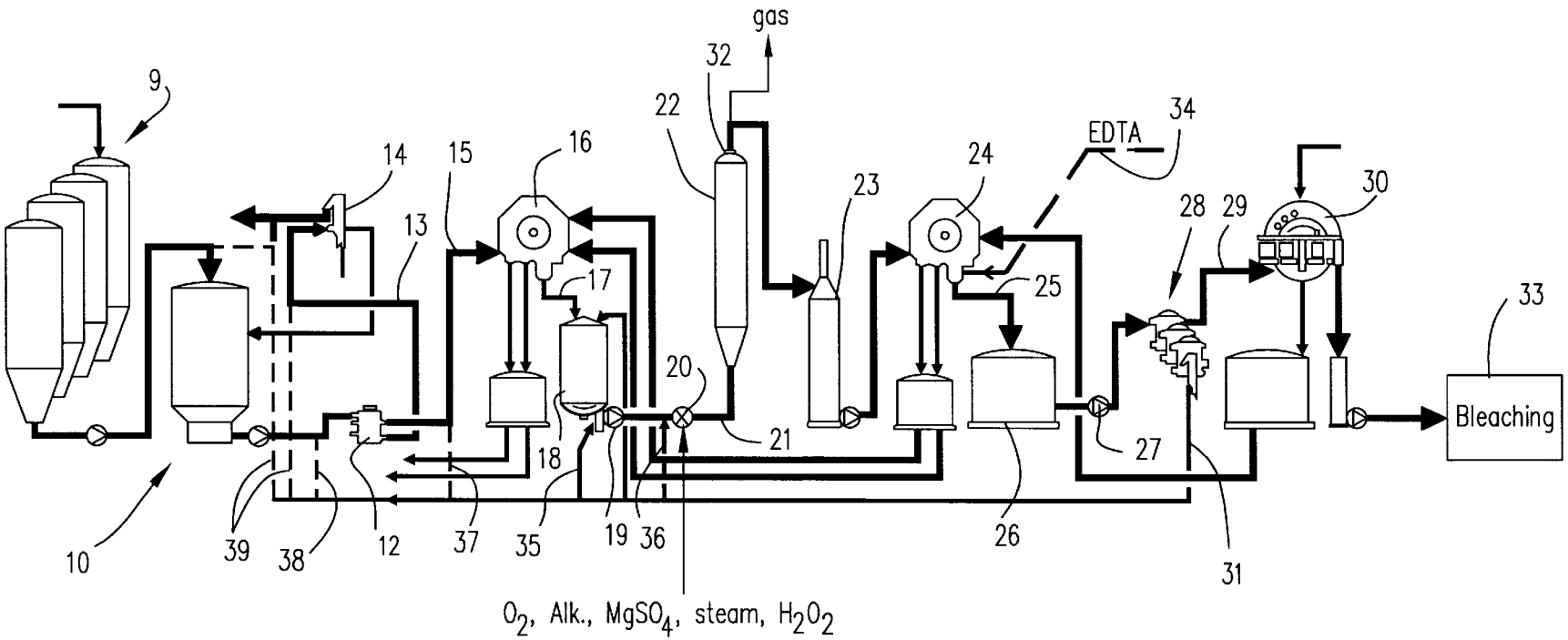
FIGS. 1 through 4 are schematic illustrations of four different embodiments of chemical pulp producing fiber line systems according to the present invention for practicing the methods of producing chemical pulp according to the present invention.

An exemplary first embodiment of a chemical pulp producing fiber line system according to the present invention is shown in FIG. 1. The system includes a digester 9 for cooking cellulosic fibrous material (such as wood chips, e.g. in a kraft process) to produce brown stock pulp. The digester 9 is illustrated in FIG. 1 as a plurality of conventional batch digesters, which may be utilized in the practice of the invention. Alternatively, however, a single continuous digester, such as sold by Ahlstrom Machinery of Glens Falls, N.Y., may be utilized.

Downstream of the digester 9 is a dilution vessel 10, and typically a first coarse screen 12 from which coarse rejects in line 13 pass to a conventional coarse rejects washer 14. The brown stock pulp passes from coarse screen 12 in line 15 to a conventional brown stock washer 16 where washing takes place. Typically the pulp passes from the brown stock washer 16 (such as a DrumDisplacer™, sold by A. Ahlstrom Corporation of Helsinki, Finland) in line 17 to an intermediate cistern 18 which includes a discharge pump or other mechanical device 19 or the like. Preferably the discharge pump is a fluidizing medium consistency pump. From device 19 the pulp passes in line 21 to a mixer 20. The mixer 20 may be any suitable conventional mixer (including fluidizing mixers, such as MC® mixers sold by Ahlstrom Machinery) which is capable of mixing the pulp with oxygen and typically other delignification-facilitating chemicals, in addition to subjecting the pulp to mechanical action. For example as illustrated schematically in FIG. 1 in addition to gaseous oxygen being added to the mixer 20, typically alkali, magnesium (such as in the form of MgSO4), steam, and perhaps even a small amount of hydrogen peroxide, are added.

The oxygen delignification stage in the system of FIG. 1 includes a mixer 20 and an upflow vessel 22 in which the bulk of the oxygen delignification reaction takes place. The pulp is at a consistency of between about 6–18% (e.g. about 8–15%, e.g. about 10–13%) during oxygen delignification. From the top of the vessel 22 to the pulp passes—e.g. through an intermediate holding vessel 23—to a conventional oxygen delignification stage washer 24. The oxygen delignified, washed, chemical pulp is discharged from the washer 24 in line 25, and may pass to a dilution vessel 26 where the pulp is diluted to a typical consistency of between about 1–5%. Where a medium consistency screen is utilized, however, dilution is not necessary.

After the pulp is diluted from a consistency of 6–18% to a consistency of between about 1–5% in vessel 26, it is then pumped, such as by pump 27, to a screening stage 28. Screening stage 28 is conventional and screens the chemical pulp to produce an accepts fraction in line 29 which typically passes to a thickener 30 to raise the consistency back up to about 6–18% (or perhaps higher depending upon the particular downstream treatment utilized), while the shive-containing rejects pass into line 31. Preferably gas separation is also practiced during oxygen delignification, such as by utilizing a conventional gas separator illustrated schematically at 32 in FIG. 1 as a discharge device at the top of the upflow vessel 22.

While the various components may vary significantly, typically the brown stock washer 16 thickens the pulp during washing to medium consistency (e.g. between about 6–18%) while removing cooking liquor and dry matter dissolved in the cooking liquor. Steam is added in mixer 20 where necessary to reach conventional optimal process conditions for oxygen delignification, the amount of steam added to the mixer 20 according to the invention typically being less than is necessary in many prior art processes. The washer 24 also is typically a DrumDisplacer™ washer which removes the dry matter dissolved from the fibers during the oxygen delignification in vessel 22. When chelating is utilized (such as when further treatment stages, such as seen schematically at 33 in FIG. 1, include peroxide stages, particularly as the first stage thereof), chelating is typically done in the dilution vessel 26, for example by adding EDTA, or other chelating chemicals, in line 34 as illustrated in FIG. 1. Chelation removes heavy, transition, metals such as copper and iron. Acid, such as sulfuric acid, is typically added with the chelating agent such as EDTA or DTPA so that the pH of the pulp is low enough for effective metals removal. Where chelation is practiced the dilution vessel 26 typically is dimensioned for a retention time of between about 1–3 hours.

During screening in the screening stage 28, the purpose is to remove substantially all the impurities from the pulp. Sand that is removed is typically handled separately from the shive-containing reject fraction in line 31 (the sand handling not illustrated in FIG. 1).

Where bleaching, such as illustrated schematically at 33 in FIG. 1, is to be practiced at medium consistency, typically the thickener 30 is a drum filter which thickens the pulp to a consistency of between about 10–15%. However if the first process is a high consistency bleaching process, a press may be utilized as the thickener 30, in which case consistencies up to about 30% can be reached.

The screens in the screening stage 28 may be slotted screens, screens with holes, screen cylinders, screen plates, and/or combinations and modifications thereof. Also the screening stage 28 can inherently include as the last sub-stage thereof a thickening sub-stage for thickening the rejects fed into line 31. For example the rejects may be thickened to a consistency of between about 10–20%. However, it is preferred that the rejects be kept at a consistency of between about 6–18% (e.g. 8–15%, or 10–13%) to ensure proper impregnation thereof with alkaline liquor.

The rejects may be directly transported before the oxygen delignification vessel 22 at any one of a variety of places. For example as illustrated by the solid line conduit 35 in FIG. 1 the rejects fraction may be returned to the discharge from the cistern 18 (or elsewhere between the brown stock washer 16 and the mixer 20). Alternatively, or in addition, the rejects may be led—as indicated by line 36—to a place just before the mixer 20. Or as indicated by dotted line 37 the rejects may be fed to the line 15 feeding the brown stock washer 16, or as indicated by line 38 to just before the coarse screen 12, or as indicated by lines 39 to the coarse rejects washer 14 or the dilution vessel 10.

While FIG. 1 illustrates most of the apparatus/system components that may be utilized according to the invention, other equipment also may be used as is conventional. Also FIG. 1 does not illustrate many of the pumps utilized.

Figure 2:
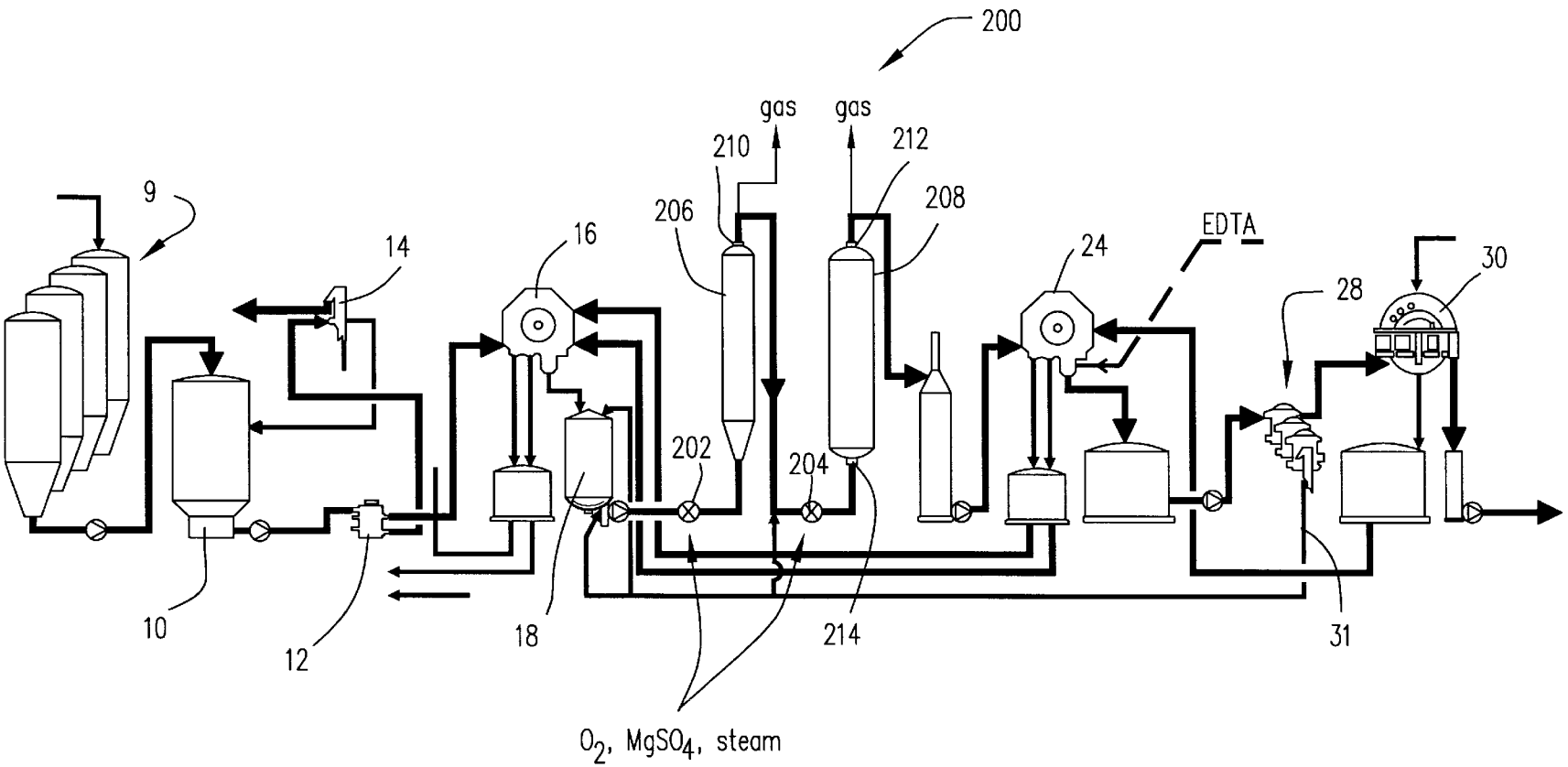

FIG. 2 shows a second embodiment of the system according to the present invention. In FIG. 2 components that are the same as those of FIG. 1 are shown by the same reference numeral, and not all of the alternatives of the recirculating line 31 return are illustrated. The primary difference between the system of FIG. 2 and that of FIG. 1 is in the oxygen delignification treatment, illustrated schematically at 200 in FIG. 2.

The oxygen delignification treatment 200 of FIG. 2 includes multiple, distinct stages. In the embodiment actually illustrated there is a first mixer 202 (for oxygen, magnesium, steam, alkali, etc.) and a second mixer 204, a first upflow vessel 206 and a second upflow vessel 208, and discharges 210, 212 from the tops of the vessels 206, 208. The mixer 204 is between the first stage vessel 206 and the second stage vessel 208, and the discharge devices 210, 212 preferably also effect degasification of the pulp. Also the bottoms of one or both of the vessels 206, 208 are provided with feeding devices. For example—as shown only with respect to the second stage vessel 208 (but also utilizable in the vessel 206) a conventional multiple feeding device 214 may be utilized. The multiple feeding device 214 is such as shown in Finnish application 924805, while the entire system 200 may be such as shown in Canadian patent 2,132,056.

The device 214 feeds pulp uniformly at several different points around the bottom of the vessel 208 so that the pulp rises up evenly, without forming channels. It has been found according to the present invention that multiple feeding utilizing the device 214 is the most effective from the point of efficiently treating shives so that the number of shives downstream of the oxygen delignification 200 is minimized or eliminated. The system allows the majority of the lignin on the surface layer of the shives to be dissolved, and also exposes the shive fibers so that the relatively gentle mechanical action provided by various mechanical components can break the shives up into individual fibers without refining. That is the oxygen delignification system 200 effects mechanical action without refining so that, combined with the oxygen delignification, the number of shives is minimized, or the shives may be eliminated completely. The mixers 202, 204, any inlet devices (such as the device 214), and any outlet scrapers, rotating elements with blades or paddles, or degasifiers (such as the devices 210, 212), while not providing sufficient force to disintegrate the shives like a refiner does, are able to separate the weakened bonds between the fibers in the shives so that the amount of material that the downstream screening stage 28 needs to handle (separate as rejects) is minimal, or where the appropriate equipment and multiple stages are used at 200, eliminated. While two stages (i.e. two vessels 206, 208 each with their own mixer 202, 204, respectively) are illustrated in FIG. 2, it is to be understood that additional distinct stages may also be utilized, and typically there is no between stage washing.

Figure 3:
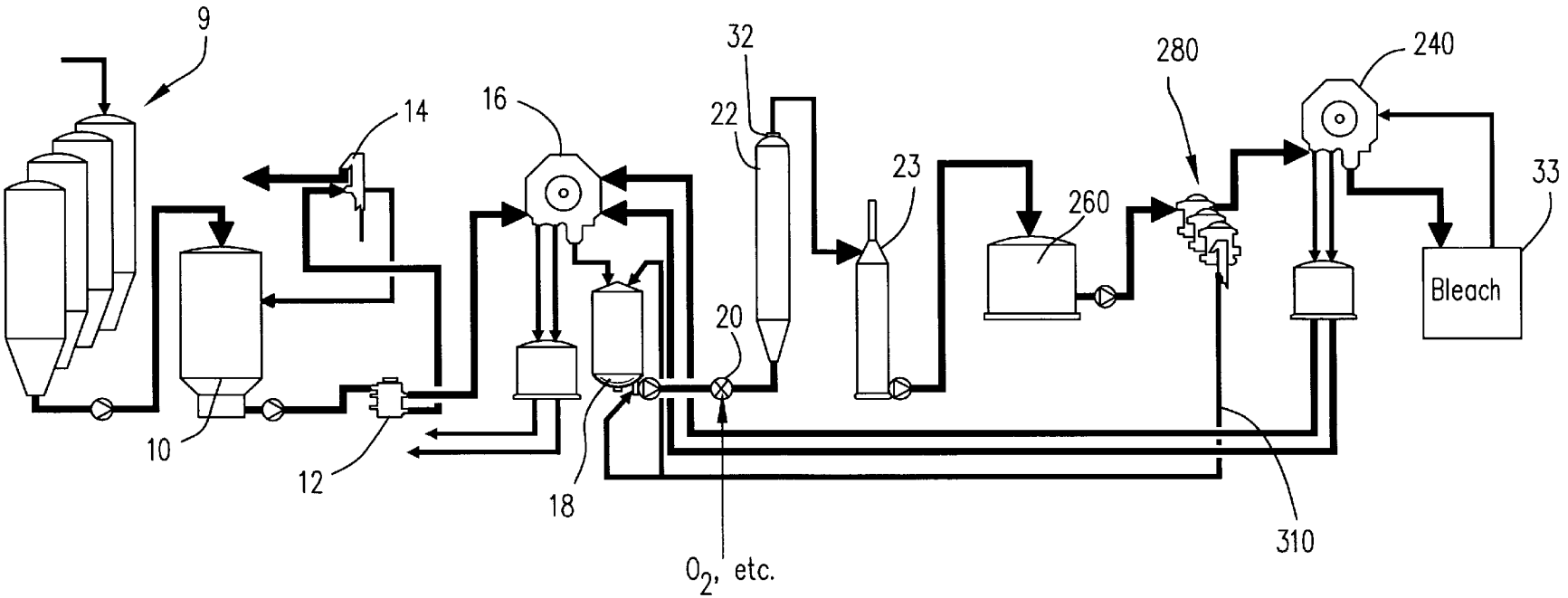

In the embodiment illustrated in FIG. 3, components the same as those in FIG. 1 are shown by the same reference numeral. Components comparable to those in FIG. 1 but only rearranged in position are shown by the same reference numeral followed by a zero.

The difference between the FIG. 3 and FIG. 1 embodiment is in the position of the dilution tank 26, oxygen delignified pulp washer 240, and screening stage 280. The dilution vessel 260 is placed substantially immediately after the oxygen delignification, and upstream of the washer 240. The washer 240 is also downstream of the screening stage 280.

The embodiment of FIG. 3 has one advantage over the embodiment of FIG. 1, in that only one device is needed instead of two to effect washing and thickening of the oxygen delignified pulp. That is the washer 240—which also can act as a thickener—is provided in place of the washer 224 and thickener 30 in the FIG. 1 embodiment. Where the first bleach stage, 33, will be peroxide bleaching, chelating of the pulp can be provided downstream of the screening stage 280 and the washer 240.

Figure 4:
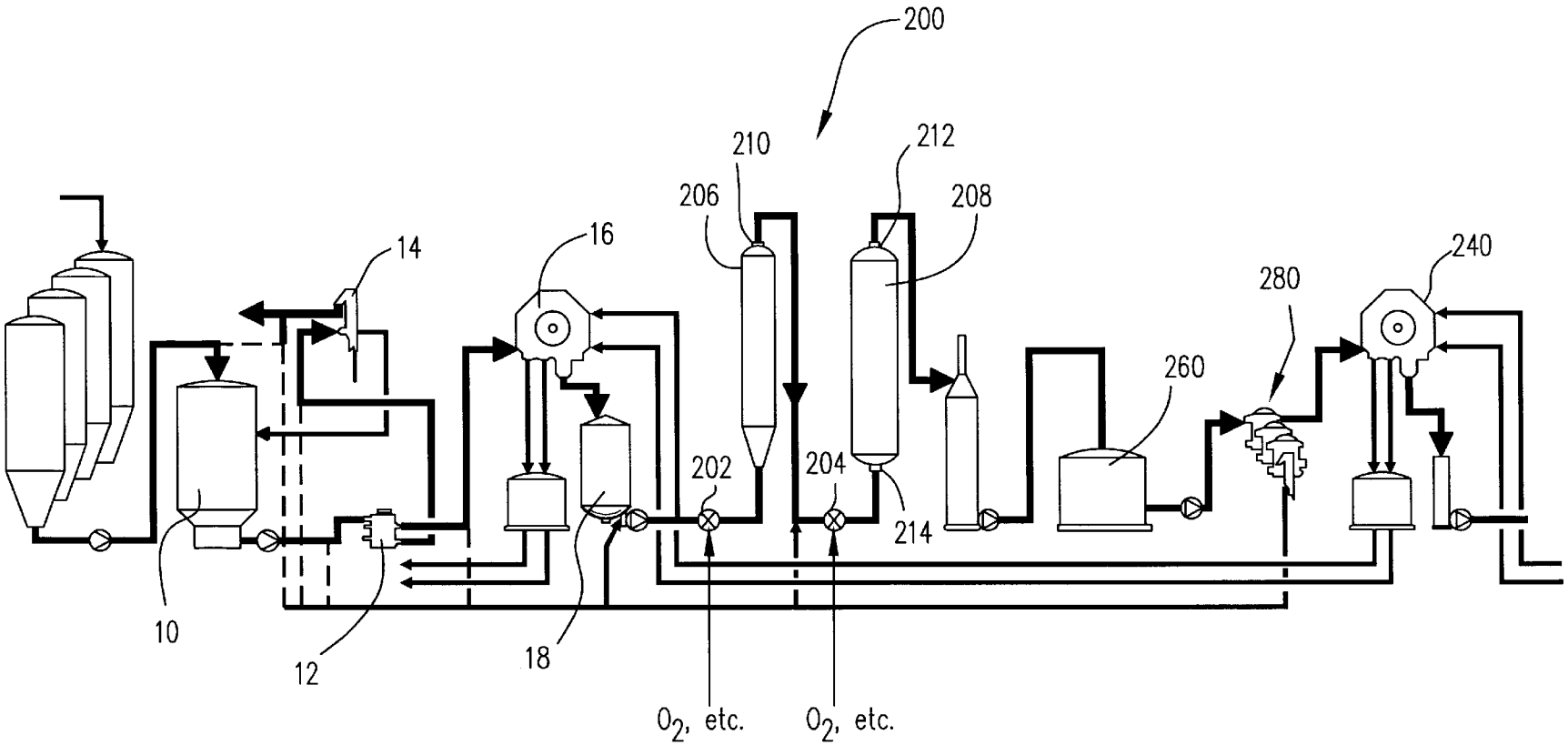

The embodiment of FIG. 4 is a combination of the embodiments of FIGS. 2 and 3. That is it includes the same oxygen delignification treatment 200 as the FIG. 2 embodiment, but includes the relative positioning of the dilution tank 260, screening stage 280, and washer 240 illustrated in FIG. 3.

While the various illustrated embodiments show the coarse screen 12, with the coarse reject washer 14, before the brown stock washer 16, it is also possible to dispose the coarse screen 12 (and associated washer 14) between the brown stock washer 16 and the oxygen delignification stage (vessel 22, or treatment 200), or downstream of the oxygen delignification (vessel 22, or treatment 200) but before the washer 24 (or 240). The location of the coarse screen 12 has little affect on the efficiency of the method according to the present invention.

It will thus be seen that according to the present invention an efficient method of producing chemical pulp, having a minimal amount of rejects in the final pulp produced, is provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c); and (f) separating gas from the pulp during the practice of step (c).

2. A method as recited in claim 1 wherein steps (c)–(f) are practiced to allow the reject fraction to be impregnated by alkaline liquid for enhancing the delignification and separation of fibers of and from shives.

3. A method as recited in claim 1 comprising the further step (g) of washing the oxygen delignified chemical pulp between steps (c) and (d).

4. A method as recited in claim 1 comprising the further step (g) of washing the oxygen delignified chemical pulp as part of step (e).

5. A method as recited in claim 1 wherein step (c) comprises oxygen delignifying the chemical pulp at a consistency of about 6–18% in at least first and second consecutive distinct stages, and comprising the further step (g)

of mechanically mixing oxygen into the pulp prior to the first oxygen delignification stage, and between the first and second oxygen delignification stages, and treating the reject fraction by mechanical action in the main fiber line for loosening fibers from the shives.

6. A method as recited in claim 1 wherein step (f) is practiced at a consistency of the reject fraction of between about 8–15%.

7. A method as recited in claim 1 wherein step (b) is practiced using a brown stock washer, and comprising the further step of coarse screening the pulp with a coarse screen and washing the coarse rejects from the coarse screen; and wherein step (c) includes mixing oxygen with the pulp in a mixer; and wherein step (f) is practiced to directly transport the pulp to just before the mixer, or between the brown stock washer and the mixer, or to just before the coarse screen, or to the coarse reject washer.

8. A method as recited in claim 1 comprising the further step, during the practice of step (c), of subjecting the pulp to mechanical action without refining.

9. A method as recited in claim 1 comprising the further step (g), between steps (b) and (c), of coarse screening the pulp to produce coarse rejects, and washing the coarse rejects and returning the washed coarse rejects to step (a).

10. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c), wherein step (c) comprises oxygen delignifying the chemical pulp at a consistency of about 6–18% in at least first and second consecutive distinct stages, and comprising the further step (g) of mechanically mixing oxygen into the pulp prior to the first oxygen delignification stage, and between the first and second oxygen delignification stages, and treating the reject fraction by mechanical action in the main fiber line for loosening fibers from the shives, and wherein the pulp is not subjected to between stage washing between the oxygen delignification steps.

11. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c), wherein step (c) comprises oxygen delignifying the chemical pulp at a consistency of about 6–18% in at least first and second consecutive distinct stages, and comprising the further step (g) of mechanically mixing oxygen into the pulp prior to the first oxygen delignification stage, and between the first and second oxygen delignification stages, and treating the reject fraction by mechanical action in the main fiber line for loosening fibers from the shives, and comprising the further step (h) of separating gas from the pulp in at least one of the oxygen delignification stations.

12. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept traction and a shive-containing reject fraction;

steps (a)–(d) being practiced in a main fiber line; and then after step (d):

(e) further treating the accept fraction, and (f) directly transporting the shive-containing reject fraction back to the main fiber line before step (c), wherein step (c) comprises oxygen delignifying the chemical pulp at a consistency of about 6–18% in at least first and second consecutive distinct stages, and comprising the further step (g) of mechanically mixing oxygen into the pulp prior to the first oxygen delignification stage, and between the first and second oxygen delignification stages, and treating the reject fraction by mechanical action in the main fiber line for loosening fibers from the shives, and comprising the further step (h) of effecting chelating treatment of the pulp between steps (c) and (d).

13. A method as recited in claim 12 comprising the further step (i), between steps (c) and (d), of washing the oxygen delignified pulp, and wherein step (h) is practiced after step (i).

14. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c), wherein, step (c) comprises oxygen delignifying the chemical pulp at a consistency of about 6–18% in at least first and second consecutive distinct stages, and comprising the further step (g) of mechanically mixing oxygen into the pulp prior to the first oxygen delignification stage, and between the first and second oxygen delignification stages, and treating the reject fraction by mechanical action in the main fiber line for loosening fibers from the shives, and wherein during the practice of step (c) the pulp flows upwardly during each of said first and second oxygen delignification stages, and wherein during the practice of at least one of the oxygen delignification stages the pulp is caused to flow upwardly utilizing a multiple feeding device.

15. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c); wherein step (c) is practiced by causing the pulp to flow upwardly utilizing a multiple feeding device, and wherein the pulp is at a consistency of between about 8–15%.

16. A method of producing chemical pulp, comprising the steps of:

(a) cooking comminuted cellulosic fibrous material to produce brown stock having shives;

(b) washing the brown stock to produce chemical pulp at a consistency of between about 6–18%;

(c) oxygen delignifying the chemical pulp at a consistency of between about 6–18%;

(d) screening the pulp from step (c) to produce at least an accept fraction and a shive-containing reject fraction;

steps (a)–(d) being practiced in a main fiber line; and then after step (d):

(e) further treating the accept fraction, and (f) directly transporting the shive-containing reject fraction back to the main fiber line before step (c); and comprising the further step (g) of effecting chelating treatment of the pulp between steps (c) and (d).

17. A chemical pulp producing fiber line system, comprising:

a fiber line comprising in sequence: a digester for cooking cellulosic fibrous material to produce brown stock; a first washer for washing the brown stock from said digester; at least one oxygen delignification stage; and a screening stage for screening chemical pulp from said oxygen delignification stage to produce an accepts fraction and a shive-containing rejects fraction; and means for directly transporting the shive-containing rejects fraction to said fiber line before a said oxygen delignification stage, and wherein said at least one oxygen delignification stage comprises first and second upflow oxygen delignification vessels, at least one of said vessels comprising a multiple feeding device; and means for subjecting the pulp to mechanical action without refining while oxygen delignifying the pulp.

18. A system as recited in claim 17 wherein said digester comprises a single continuous digester or a plurality of batch digesters; and further comprising a coarse screen between said digester and said brown stock washer; and an oxygen delignified pulp washer between said at least one oxygen delignification stage and said screening stage, or just after said screening stage.

19. A method of producing chemical pulp comprising the steps of:

(a) cooking comminuted cellulosic fibrous material to produce brown stock;

(b) washing the brown stock to produce chemical pulp; and (c) oxygen delignifying the chemical pulp at a consistency of between about 6–18%, and to allow the shives to become impregnated by alkaline liquid to enhance separation of fibers; and wherein oxygen delignification is practiced utilizing at least first and second distinct oxygen delignification stages each comprising an upflow vessel, and at least one of the vessels including a multiple feeding device; and (d) during the practice of step (c), subjecting the pulp to mechanical action without refining so as to produce an oxygen delignified chemical pulp substantially devoid of shives so that downstream screening of the oxygen delignified pulp is unnecessary.

20. A method as recited in claim 19 comprising the further step (e) of mechanically mixing oxygen into the pulp prior to the first oxygen delignification stage, and between the first and second oxygen delignification stages.

21. A method as recited in claim 19 wherein the pulp is not subjected to between stage washing between the oxygen delignification stages in the practice of step (c).

22. A method as recited in claim 19 comprising the further step of separating gas from the pulp during the practice of step (c).

* * * * *